US005207448A

United States Patent [19]

Bonvallet

[11] Patent Number: 5,207,448

[45] Date of Patent: May 4, 1993

[54] INERTIA COMPENSATED STEP-IN SKI BINDING

[76] Inventor: Duane J. Bonvallet, 3248 W. Huron River Dr., Ann Arbor, Mich. 48103

[21] Appl. No.: 858,121

[22] Filed: Mar. 27, 1992

[51] Int. Cl.[5] ..... A63C 9/085

[52] U.S. Cl. ..... 280/625; 280/634

[58] Field of Search ..... 280/625, 629, 634, 628

[56] References Cited

U.S. PATENT DOCUMENTS

| | | | |
|---|---|---|---|
| 3,692,322 | 9/1972 | Frisch et al. | 280/629 |
| 4,129,245 | 12/1978 | Bonvallet | 280/628 |
| 4,277,084 | 7/1981 | Bonvallet | 280/629 |
| 4,735,434 | 4/1988 | Sedlmair | 280/625 |
| 5,071,155 | 12/1991 | Stepanek et al. | 280/625 |

FOREIGN PATENT DOCUMENTS

| | | | |
|---|---|---|---|
| 2255604 | 5/1974 | Fed. Rep. of Germany | 280/625 |

*Primary Examiner*—David M. Mitchell

[57] ABSTRACT

An inertia compensated step-in type ski binding for releasably securing a ski boot to a ski. The binding releases the boot from the ski when the lateral force imposed on the binding by the toe of the ski boot reaches a predetermined level. The ski binding includes a mass which function to generate a force within the binding which is equal to and opposite the force generated by the lateral acceleration of the boot mass so as to eliminate lateral acceleration as a factor in release.

1 Claim, 2 Drawing Sheets

INERTIA COMPENSATED STEP-IN SKI BINDING

BACKGROUND OF THE INVENTION

I. Field of the Invention

This invention relates in general to a ski binding and, specifically, to an inertia compensated ski binding which releasably binds a skier's boot to his ski and functions to cancel the forces generated by acceleration of the boot mass.

II. Description of the Prior Art

Ski bindings are designed to releasably hold a skier's boot to his ski with sufficient force to enable the skier to adequately control his skis while at the same time allowing the skier's boot to be released from the ski should the forces acting on his leg become great enough to injure him. The releasable ski binding which holds the skier's boot to the ski must allow for release of the skier's boot in the horizontal plane, including moments which tend to twist the skier's leg.

A popular type of ski binding is the so-called "step-in" binding in which the toe of the boot engages a rotatable toe-unit and the heel of the boot engages a releasably latched heel-unit. The rotatable toe-unit releases the boot from the ski by rotating about its pivot until release occurs. The rotatable toe-unit is held against rotation by adjustable spring loaded stops that prevent rotation until the moment resulting from the toe of the boot acting laterally on the toe-unit exceeds the preload. Most modern ski bindings provide a certain amount of toe-unit rotation before release occurs; this is done so that short duration impacts do not cause release. The force acting on the binding must exceed the preload long enough to allow the boot to travel through this distance before release occurs. Thus, a moment acting on the rotatable toe-unit having a pulse height and pulse width exceeding the predetermined shock work absorption capacity of the ski binding will automatically result in a release of the ski boot, whether or not significant leg forces are present.

Dynamic accelerations resulting from short duration impacts while skiing are usually referred to as "shock" by those skilled in the art of releasable ski bindings—the ability of a ski binding to not release prematurely because of "shock" is referred to as its "anti-shock capability". In this document, the term acceleration will be used instead of "shock" when referring to the time rate of change of velocity.

It has been established that there are two significant sources of force that act on ski bindings to cause release; these are the external leg forces involved in directing the ski, and the internal acceleration force resulting from the acceleration of the boot mass. Since these two forces are additive and can exist simultaneously, premature release of a binding during aggressive skiing can occur without a fall or the skier being in danger of injury because of the dynamic accelerations of the boot mass. The competitive skier is at greater risk of leg injury than the recreational skier because of the larger accelerations induced by high speed aggressive skiing on compacted surfaces. To prevent premature binding release the competitive skier increases the moment preload of the toe-unit, sometimes beyond that which his legs can sustain. When the competitive skier has a twisting fall where large acceleration are not present, the binding preload is too high for the leg forces alone to cause boot release and the skier's leg is injured.

A new type of ski binding has been developed which eliminates the internal acceleration forces acting to release the ski binding. U.S. Pat. No. 4,129,245 discloses a "plate-type" acceleration compensated device for ski bindings which comprises a pivot member adapted to engage a portion of a plate to which the ski boot is attached. The pivot member is pivotally carried such that the boot plate engaging portion of the pivot member is on one side of the pivot, and a mass connected to the pivot member is on the other side of the pivot. The mass is sized and positioned on the pivot member to generate a moment at the pivot equal and opposite to the moment generated by the boot mass during lateral or vertical acceleration of the boot to thereby eliminate acceleration as a factor in boot release. A shortcoming of "plate-type" ski bindings is the loss of feel of the skis caused by the "plate" between the boot and the ski; because of this shortcoming, the "plate-type" ski binding is used very little today. U.S. Pat. No. 4,277,084 discloses an acceleration compensated step-in ski binding that includes a pivotable toe-unit mounted on a support plate attached to the ski which engages the boot on one side of a first pivot and carries a mass on the opposite side of the first pivot. The mass is sized and positioned to generate a moment equal and opposite to the moment generated by lateral acceleration of the boot mass to eliminate lateral acceleration as a factor in boot release. The binding further includes a toe-cup assembly (for engaging the boot toe) that is coupled to the pivotable body member with a second pivot and parallel links that allow the toe-cup assembly to translate across the ski, under the influence of external lateral forces, without rotating. This assures that the effective fulcrum length between the first pivot axis and the boot mass is constant, to maintain the proper functioning of the acceleration compensating mechanism, despite the variability of the location at which the ski boot can contact the toe-cups. A shortcoming of this invention is that all the ski boot forces are imposed on the first pivot, requiring the first pivot to be strong enough to carry these large forces and precludes short fulcrum length between the pivot axis and the toe cup assembly. Additionally, ice can accumulate on the parallel link and interfere with proper release of the boot from the ski.

SUMMARY OF THE INVENTION

This invention describes a new and improved inertia compensated step-in type ski binding for releasably securing a ski boot to a ski. A ski binding is comprised of a toe-unit and a heel-unit. This invention describes the toe-unit only, as the toe-unit is the one that must release laterally and be inertia compensated to protect the skier from leg injury. Heel-units provide release primarily in the vertical direction and inertia compensation is less important. The toe-unit includes a toe-cup assembly that engages the toe portion of the ski boot. The toe-cup assembly is mounted to the toe-unit by means of parallel links that allow the toe-cup assembly to translate across the ski under the influence of external lateral forces without rotating; the parallel links carry the vertical forces between the boot and the ski.

The toe-cup assembly engages a balance member on one side of its pivot axis. The balance member has a mass slidably attached on the other side of its pivot axis. The distance from the center of gravity of the slidable mass and the pivot axis is adjusted to generate a moment equal and opposite to the moment generated by the boot mass on the other side of the pivot and its distance from the pivot. The moments are equal and opposite for all values of acceleration, thus eliminating acceleration as a factor in binding release. The balance member is compliantly held in a centered position by a centering mechanism comprised of stops and adjustable preload springs. Thus, the toe-cup assembly is held centered until the lateral force imposed on the toe-unit by the boot exceeds the preload of the centering mechanism. The balance member is housed within a cover to prevent accidental contact with active components of the release mechanism and exclude ice from the mechanism.

A step-in type ski binding constructed according to the teachings of this invention provides inertia compensation that cancels the internal forces caused by acceleration of the boot mass, that previously led to premature binding release, without the shortcomings of prior inventions. Because the vertical forces imposed by the ski boot on the toe-unit are carried on parallel links instead of the main pivot, the main pivot diameter can be small, allowing the boot mass acceleration force to be introduced closer to the pivot, reducing the overall size and weight of the toe-unit. By enclosing the mechanism, the acceleration compensating means, once initially balanced, continues to function properly regardless of icing conditions or contact by the other ski, the skiing surface or foreign objects.

BRIEF DESCRIPTION OF THE DRAWINGS

The various features, advantages and other uses of this invention will become more apparent by referring to the following drawings in which.

DESCRIPTION OF THE PREFERRED EMBODIMENT

Figure 1:
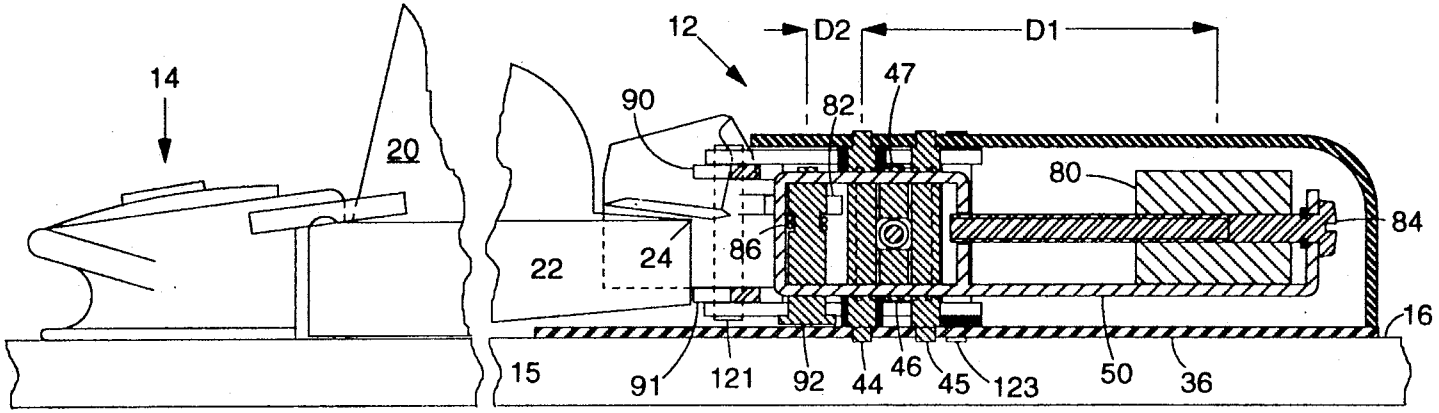
FIG. 1 is a partially sectioned side view of a ski, a heel-unit, and an inertia compensated toe-unit constructed according to the teachings of this invention.

Throughout the following description, identical reference numbers refer to the same component shown in multiple figures of the drawings.

This invention relates to an inertia compensating device for step-in bindings, and in particular the toe-unit portion shown in FIGS. 1, 2, 3, and 4. Although this invention describes the inertia compensating mechanism applied to the toe-unit portion, it can also be applied to the heel-unit, or to both the toe and heel units Referring to FIGS. 1 and 2, there is shown a ski 15, and a ski binding of the so-called "step-in" type comprised of a heel-unit 14, and a toe-unit 12. The ski binding toe-unit 12 is mounted to the upper surface 16 of a conventional ski 15 for the purpose of releasably securing a ski boot 20 to the ski 15. The ski boot 20 includes a protrusion 22 which extends forward of the boot toe and ends in a ridge 24 along the front of the boot 20 (typical of contemporary ski boots) which engages the toe-cup assembly 94 of toe-unit 12.

The toe-cup assembly 94 is comprised of toe cups 106 and 108 and spreaders 90 and 91 pivotally joined to parallel links 130 and 131 by means of pins 120 and 121. The parallel links 130 and 131 of toe-cup assembly 94 are pivotally mounted to the support plate 36 by means of pins 122 and 123. Pins 120 and 121 are spaced the same as pins 122 and 123 to constitute a parallelogram mechanism that prevents the toe-cup assembly from rotating during translation across the ski.

Toe cups 106 and 108 restrain the ski boot laterally by contacting protrusion 22 along the vertical surfaces 109. Toe cups 106 and 108 are prevented from rotating outward by links 82 and 83 which abut against pin 92 on balance member 50.

Balance member 50 is pivotally mounted to support plate 36 by means of stationary pin 44. Passing vertically through elongated slots 74 in balance member 50 is a second stationary pin 45. Alignment pins 46 and 47 are mounted coaxially on the centerline of the inside surface of balance member 50. Resilient means 70, such as coil springs, are disposed on each side of spring plates 71, which when pushed together by springs 70 align coaxial alignment pins 46 and 47 with pins 44, 45, thus holding the toe-cup assembly in a centered position. When ski boot protrusion 22 exerts a lateral force on toe cup 108, toe-cup 108 is restrained from rotating by link 82 abutting against pin 92. The lateral force is transmitted to pin 120 through spreaders 90 and 91. The toe-cup assembly is restrained from moving laterally by link 83 between toe-cup 106 and pin 92. Balance member 50 will not rotate on pin 44 until the spring preload is overcome.

Figure 2:
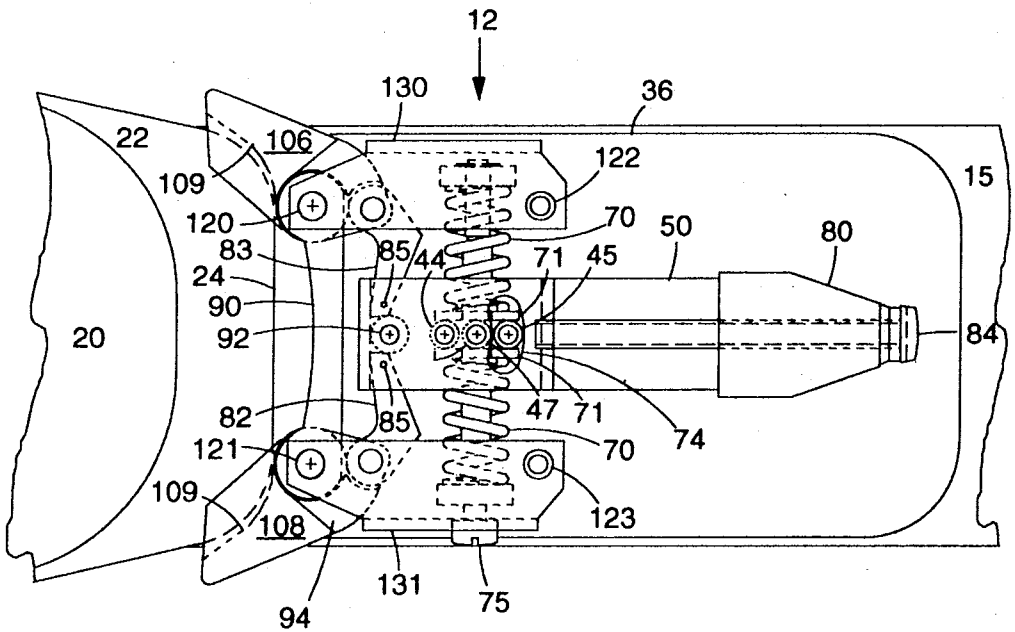
FIG. 2 is an unsectioned plan view of the inertia compensated toe-unit with the cover removed.
Figure 3:
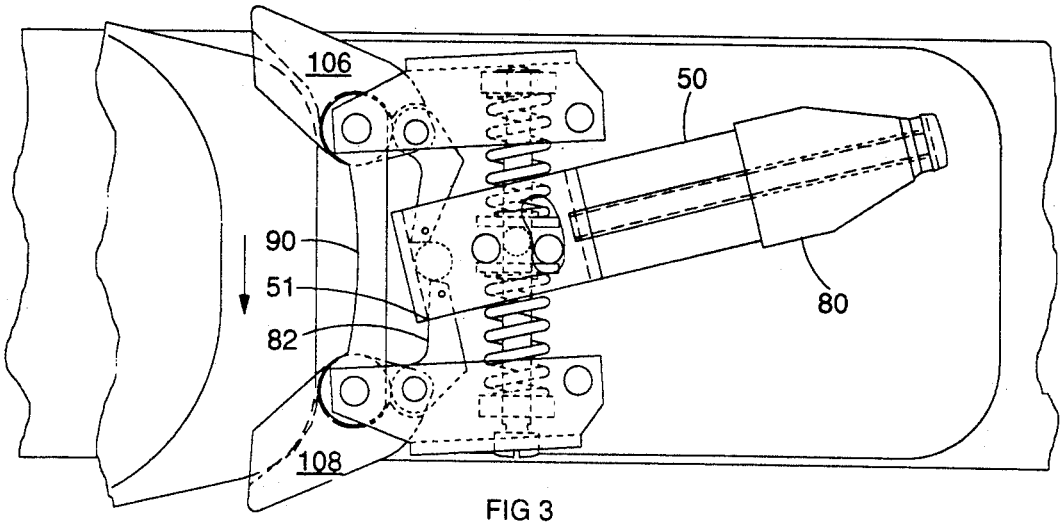
FIG. 3 is similar to FIG. 2 showing the ski binding deflected by an external lateral force but not released.
Figure 4:
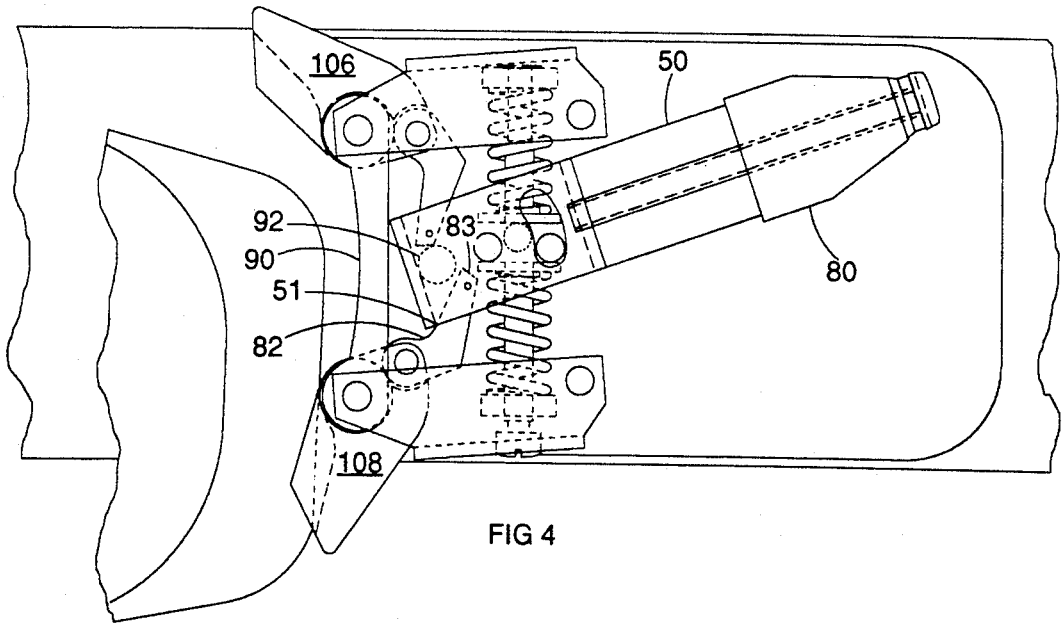
FIG. 4 is similar to FIG. 3 showing the ski binding released.

The arrow in FIG. 3 designates a lateral force imposed on toe cup 108 by the ski boot great enough to overcome the spring preload; balance member 50 is shown partially rotated because of this force. Rotation of balance member 50 brings the corner 51 of balance member 50 into contact with link 82. As balance member 50 rotates further (shown in FIG. 4) corner 51 pushes link 82 forward until its thrust end 83 slips off of pin 92, allowing toe cup 108 to rotate outward releasing the boot as shown. After ski boot 20 has been released, springs 70 pushing on spring plates 71, realign coaxial alignment pins 46 and 47 with pins 44, 45, returning balance member 50 to center as shown in FIG. 2. Referring to FIGS. 1 and 2, the torsion spring 86 (not shown in FIGS. 2, 3 and 4), mounted coaxially around pin 92, engages holes 85 in links 82 and 83, and serve to move links 82 and 83 to their unreleased positions shown in FIG. 2.

Referring again to FIGS. 1 and 2, balance member 50 is provided with mass 80 which can be positioned fore and aft along balance member 50 by means of adjusting screw 84. Mass 80 is positioned fore and aft along the balance member 50 to produce a moment about pin 44 (mass80×D1) that is equal and opposite to the moment caused by the boot toe mass (boot toe mass×D2). Because mass 80 is less than the boot toe mass by the ratio of D2/D1, it is desirable to have D2 as short as possible to reduce mass 80 and thus the total weight of the toe-unit. Because the vertical boot toe force is not imposed on pin 44, it can be sized to carry only the inertia compensating forces, minimizing D2 and mass 80.

In use, prior to skiing, the skier positions mass 80 to produce a moment about pin 44 that is equal and opposite to the moment produced by the ski boot toe mass on the other side of pin 44. The skier can then adjusts spring 70 preload, using spring adjuster 75, to release at a force less than that that could cause a leg injury, without fear of premature release due to "shock". Spring adjuster 75 is provided with a right hand thread on one end and a left hand thread on the other end so that turning adjuster 75 will compress both springs 70 simultaneously or release both springs 70 simultaneously depending on which direction adjuster 75 is rotated.

In summary, there has been disclosed herein, a new and improved inertia compensated step-in type ski binding. By carrying the vertical boot toe forces on parallel links instead of the pivot member, the inertia compensating pivot member need only sustain the inertia compensating forces and can be supported on a minimum diameter pivot, allowing the lever ratio to be maximized and the total toe-assembly weight to be minimized.

What is claimed is:

1. An inertia compensated ski boot release device for a safety ski binding comprising:

a support plate fixable mounted to a ski;

a toe-cup assembly pivotably carried by the support plate on a first pair of vertical pivots; said toe cup assembly including a pair of laterally spaced toe cups which engage the boot toe;

a two-link parallel motion mechanism, each link pivotably attached to the toe-cup assembly and to one of the first pair of pivots to allow lateral motion of the toe-cup assembly in an arc about the first pair of pivots without rotation of the toe-cup assembly;

a balance member pivotally mounted on a vertical pivot attached to the support plate, and extending longitudinally of the ski between the links of the two-link parallel motion mechanism, spring means extending laterally between each link and the balance member and cooperating to center the balance member on the support plate and prevent movement of the toe-cup assembly until the moment generated by lateral boot force exceeds a spring preload;

means for releasing the toe cups, allowing them to rotate outward, releasing the ski boot when the toe-cup assembly has reached the design limit of travel, said releasing means including:

a stop on the forward end of the balance member, a set of links, pivotably attached to the toe cups, said links normally abutting against said stop on the balance member and preventing the toe cup from pivoting, said stop moving out of contact with the links at the limit of travel of the toe-cup assembly, to enable pivoting of the toe cup, a mass;

means for slidably attaching the mass to the balance member on the opposite side of the second pivot from the toe-cup assembly to generate a moment about the second pivot, under the influence of lateral acceleration, that is equal and opposite to the moment generated by the boot mass to cancel the internal acceleration force generated by the boot mass.

* * * * *